US005486838A

United States Patent [19]

Dienes

[11] Patent Number: 5,486,838

[45] Date of Patent: Jan. 23, 1996

[54] BROADBAND OMNIDIRECTIONAL MICROWAVE ANTENNA FOR MINIMIZING RADIATION TOWARD THE UPPER HEMISPHERE

[75] Inventor: Geza Dienes, Claremont, Calif.

[73] Assignee: Andrew Corporation, Orland Park, Ill.

[21] Appl. No.: 229,553

[22] Filed: Apr. 19, 1994

Related U.S. Application Data

[63] Continuation-in-part of Ser. No. 110,590, Aug. 23, 1993, abandoned.

[51] Int. Cl.[6] ..... H01Q 19/14

[52] U.S. Cl. ..... 343/781 R; 343/781 P; 343/781 CA

[58] Field of Search ..... 343/781 R, 781 P, 343/781 CA, 782; H01Q 19/14

[56] References Cited

U.S. PATENT DOCUMENTS 4,263,599 4/1981 Bielli et al. ..... 343/781 R

FOREIGN PATENT DOCUMENTS 2334216 7/1977 France ..... 343/781 R
2600944 7/1976 Germany ..... 343/781 R

OTHER PUBLICATIONS

Takeichi et al, "The Omnidirectional Horn Reflector Antenna", G–AP International Symposium, 14–16 Sep. 1970, pp. 40–47.

Hines, "The Electrical Characteristics of the Conical Horn–Reflector Antenna", *The Bell System Technical Journal,* Jul. 1963, pp. 1187–1194.

Colman et al. "W Sidelobe Antennas for Millimeter Wave Communication Systems" Electronics Technology Div. of Naval Research Lab., Washington, D.C. pp. 240–243.

*Primary Examiner*—Donald T. Hajec
*Assistant Examiner*—Hoanganh Le
*Attorney, Agent, or Firm*—Arnold, White & Durkee

[57] ABSTRACT

An omnidirectional microwave antenna comprises a conical reflector and a conical feed horn. The conical reflector has a reflecting surface defined by a cone having an axis and a surface of revolution around the axis. The line of intersection between the surface of revolution and a plane passing through the axis and the surface of revolution is a segment of a parabolic curve. The reflector includes a flange extending outward from an outermost circumference of the surface of revolution of the cone. The conical feed horn feeds microwave energy to the conical reflector from a location along the axis of the cone. The feed horn has an aperture whose center is located approximately at the apex of the cone. The flange has absorptive material mounted thereto for absorbing microwave energy impinging thereon.

17 Claims, 2 Drawing Sheets

BROADBAND OMNIDIRECTIONAL MICROWAVE ANTENNA FOR MINIMIZING RADIATION TOWARD THE UPPER HEMISPHERE

REFERENCE TO RELATED APPLICATION

This application is a continuation-in-part of U.S. patent application Ser. No. 08/110,590, filed Aug. 23, 1993, now abandoned.

FIELD OF THE INVENTION

The present invention relates to omnidirectional microwave antennas and, more particularly, to omnidirectional microwave antennas which are capable of reducing the amount of radiation toward and into the upper hemisphere.

BACKGROUND OF THE INVENTION

There are a number of new microwave distribution systems under development using frequencies above 10000 MHz. Inter-satellite communications use the 28000 MHz frequency range. Multi-channel or interactive television would use the 27500–29500 MHz frequency range, while some wireless cable operators are opting for the 12 GHz CARS band. This activity has prompted a strong interest in base station antennas (similar to the broadcast television antennas). The antennas need to operate over a fairly wide bandwidth with a moderate to high power input. The azimuth coverage requirement, in most cases, is omnidirectional. The polarization may be either horizontal or vertical.

Omnidirectional antennas are traditionally arrays of basic radiating elements such as slots or dipoles. However the requirement for broad band operation is not compatible with linear array technology. The problem is further complicated by the relatively high power requirements (up to 2 Kw) at these high frequencies.

SUMMARY OF THE INVENTION

It is a primary object of the present invention to provide an improved omnidirectional antenna which is a reflector-type antenna capable of operating over a wide frequency band, at relatively high power levels, and at high frequencies. Specifically, it is an object of this invention to provide such an antenna which is capable of operating at frequencies above 10 GHz, including the 7.5 to 29.5 GHz band, and at power levels as high as 2 Kw.

It is another object of this invention to provide such an improved omnidirectional antenna which can transmit and receive signals having either horizontal or vertical polarization.

A still further object of this invention is to provide such an improved omnidirectional antenna which permits field-adjustable beam tilt by simply moving the feed along the axis of the antenna.

A further object of this invention is to provide such an improved omnidirectional antenna which produces a pattern shape that remains stable as the frequency changes.

Yet another object of this invention is to provide such an improved omnidirectional antenna which facilitates the achievement of a shaped elevation beam, which is stable with frequency, and requires only a slight change in the reflector shape.

Yet a further object of this invention is to provide an improved omnidirectional antenna which reduces the amount of radiation toward and into the upper hemisphere so as to avoid interference with satellite communications.

Other objects and advantages of the invention will be apparent from the following detailed description and the accompanying drawings.

In accordance with the present invention, the foregoing objectives are realized by providing an omnidirectional microwave antenna comprising a conical reflector having a surface of revolution defined by a segment of a parabolic curve rotated around the axis of the conical reflector, and a feed horn located on the axis of the reflector. The center of the aperture of the feedhorn is located substantially at the apex of the reflector.

DETAILED DESCRIPTION OF THE PREFERRED EMBODIMENTS

Figure 1:
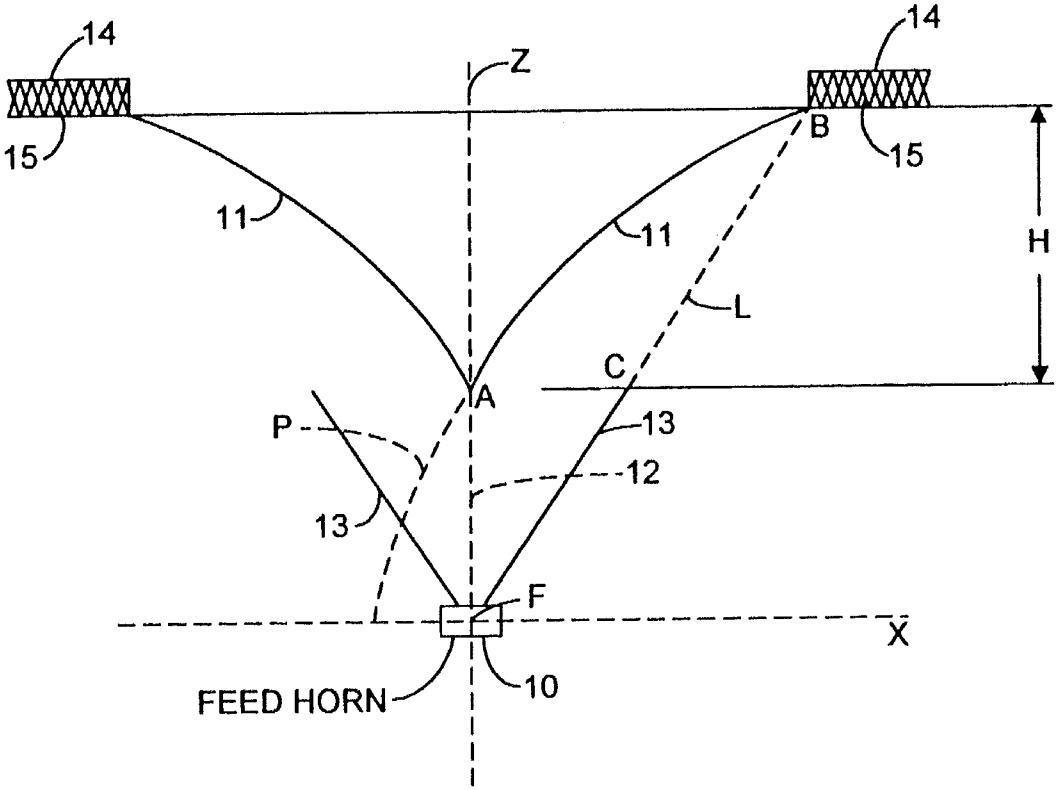
FIG. 1 is a diagram of the vertical cross-section of an antenna embodying the present invention.

While the invention is susceptible to various modifications and alternative forms, a specific embodiment thereof has been shown by way of example in the drawings and will be described in detail herein. It should be understood, however, that it is not intended to limit the invention to the particular form described, but, on the contrary, the invention is to cover all modifications, equivalents, and alternatives falling within the spirit and scope of the invention as defined by the appended claims.

Turning now to the drawings and referring first to FIG. 1, a large conical feed horn 10 feeds microwave energy to a conical reflector 11. The feed horn 10 has a circular transverse cross section, and is dimensioned to radiate energy in either the $TM_{01}$ mode or the $TE_{01}$ mode. The horn is located on the vertical axis 12 of the conical reflector 11 and radiates microwave energy upwardly so that it illuminates the conical reflecting surface and is reflected horizontally therefrom in an omnidirectional pattern (extending 360 degrees around the axis of the reflector). (The term "feed" as used herein, although having an apparent implication of use in a transmitting mode, will be understood to encompass use in a receiving mode as well, as is conventional in the art.)

The conical reflecting surface 11 defines a surface of revolution formed by rotating a segment A–B of a parabolic curve P around an axis Z which (1) is perpendicular to the axis X of the parabolic curve P, and (2) passes through the focal point F of the parabolic curve P. The axis of the feed horn 10 is coincident with the axis Z of the conical reflecting surface 11, and the electrical apex of the feed horn is approximately coincident with the focal point F of the parabolic curve P. The segment A–B of the parabolic curve P that defines the reflecting surface 11 is the segment between (1) the point A at which the feed horn axis Z intersects the parabolic curve P, and (2) the point B at which the outer edge of the reflecting surface 11 intersects a straight line L containing the sides 13 of the feed horn 10.

The axis X extends through the vertex and the focal point of the parabolic curve P. As is well known, any microwaves originating at the focal point of such a parabolic surface will be reflected by the parabolic surface in planar wavefronts perpendicular to the axis, i.e., in the horizontal direction in FIG. 1.

With the geometry described above, the conical reflecting surface 11 serves as both a 90° omnidirectional reflector and a phase corrector for the diverging spherical wave radiated by the feed horn 10. The spherical wave propagates vertically from the feed horn 10 and is reflected off the surface 11 as a planar wave propagating in a horizontal direction. This planar wave is propagated omnidirectionally, i.e., the pattern that extends completely around (360°) the axis Z. At any given azimuthal location, the parabolic shape of the reflecting surface 11 provides the desired phase correction. The height H of the parabolic segment A–B determines the directivity of the antenna in the "elevation" plane.

The mode of the radiation from the feed horn 10 determines the polarization of the antenna's omnidirectional pattern. Specifically, if the horn 10 radiates $TM_{01}$-mode energy, the polarization is vertical; and if the horn radiates $TE_{01}$-mode energy, the polarization is horizontal. Thus, by merely changing the feed horn to launch signals in either the $TM_{01}$ mode or the $TE_{01}$ mode, the same antenna may be used to transmit or receive either polarization.

The omnidirectional antenna includes several features to aid in suppressing the amount of radiation toward and into the upper hemisphere, thereby preventing interference with inter-satellite communications. More specifically, the conical feed horn 10 has a surface of revolution defined by a straight segment F-C of the straight line L rotated around the axis Z of the feed horn 10. In FIG. 1, the straight line L extends approximately from the focal point F of the parabolic curve to the point B on the parabolic curve P. The center of the aperture at the top end of the feed horn 10 is located approximately at the apex point A of the conical reflector 11 so that the sides 13 of the feed horn 10 terminate at a horizontal plane passing through the apex point A of the conical reflector 11. In other words, the point C of the segment F-C is in the same horizontal plane as the apex point A of the conical reflector 11. With the foregoing design, the feed horn 10 minimizes radiation in the horizontal direction from the large feed horn aperture which would interfere with and modify the horizontal planar wavefronts generated by the conical reflector 11. Therefore, the greatly reduced horizontal radiation from the feed horn aperture results in significantly improved radiation patterns from the conical reflector 11. Also, since the sides 13 extend from approximately the focal point F of the parabolic curve to the horizontal plane containing the apex point A of the reflector 11, the aperture of the feed horn 10 is relatively large. This large feed horn aperture serves to confine the radiation from the feed horn 10 to a smaller dispersion angle so that less radiation bypasses the conical reflector 11. This, in turn, greatly reduces the amount of radiation toward and into the upper hemisphere.

To further reduce the amount of radiation toward and into the upper hemisphere, the base of the reflector 11 is enlarged to include a flange 14 having RF absorptive material 15 mounted to the lower surface thereof. The absorptive material absorbs any radiation impinging on it. The flange 14 intercepts a significant portion of the radiation that bypasses the reflector 11 and would, if not intercepted, travel into the upper hemisphere. The absorptive material prevents the radiation intercepted by the flange 14 from being reflected and redirected downward into the lower hemisphere, where the reflected radiation would interfere with the service area the antenna is intended to serve.

Figure 2:
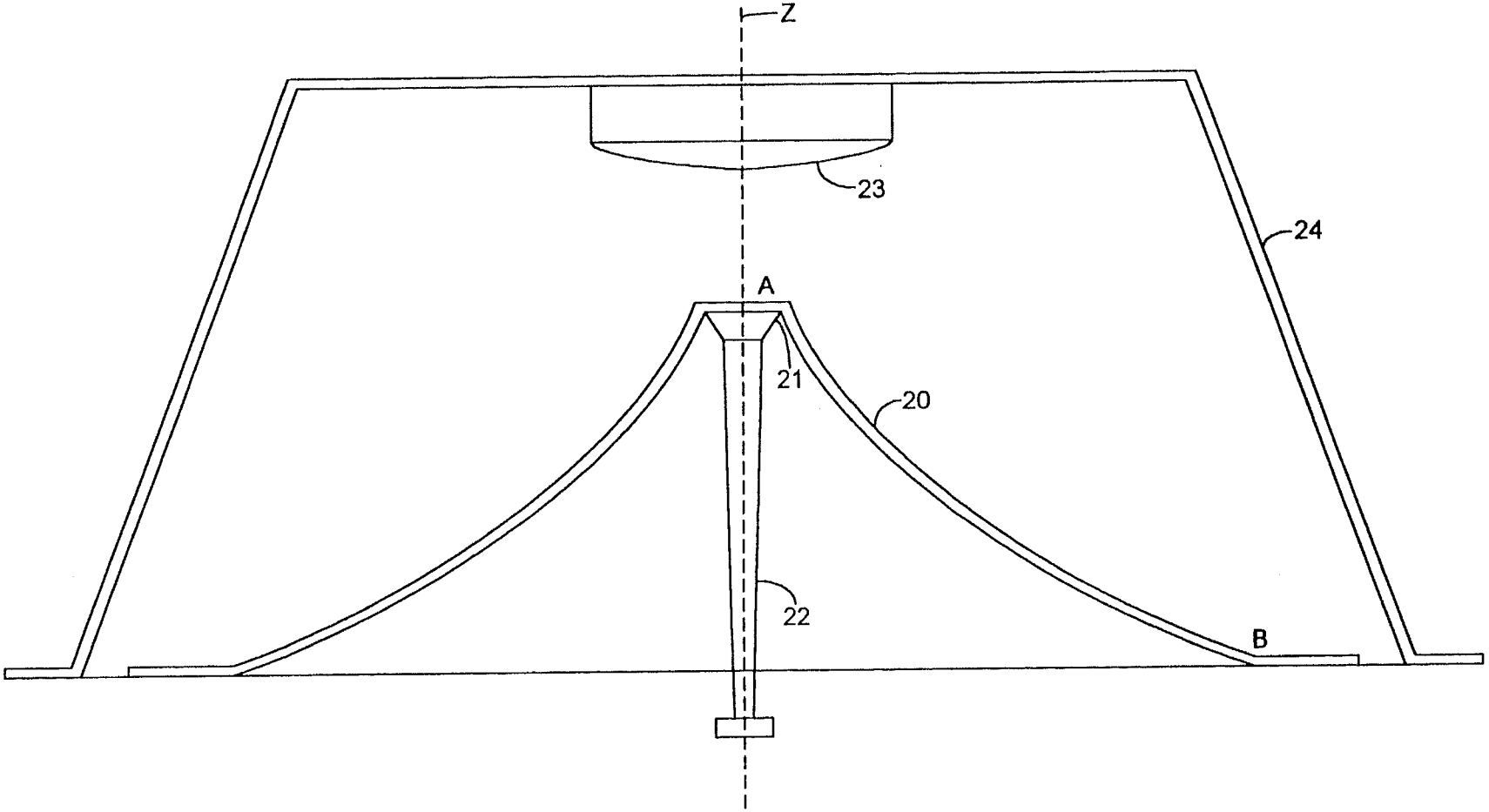
FIG. 2 is a vertical cross-section of a modified antenna embodying the present invention.

FIG. 2 illustrates a modified embodiment of the invention in which the feed device for a conical reflecting surface 20 comprises a primary feed horn 21 connected to and supported by a circular waveguide 22 extending along the axis of the reflector 20, and a subreflector 23. The conical reflecting surface 20 is still a surface of revolution formed by a segment A–B of a parabolic curve, but in this case the apex of the cone is at the top and is truncated to accommodate the feed horn 21. In the transmitting mode, the feed horn 21 receives microwave signals via the circular waveguide 22 and launches those signals onto the subreflector 23. The spherical wave launched upwardly from the feed horn 21 is reflected from the subreflector 23 as a downwardly propagating spherical wave which impinges on the conical reflector 20. The reflector 20 then reflects the wave horizontally as a planar wave, in an omnidirectional pattern extending 360° around the axis Z.

The subreflector 23, which may be supported on a radome 24, preferably has a convex hyperbolic shape and is positioned so that its virtual focal point is coincident with the phase center of the feed horn and its real focal point is coincident with the virtual focal point of the parabolic curve that defines the shape of the segment A–B of the main reflector. The subreflector 23 is positioned and dimensioned to intercept a large portion of the radiation launched from the feed horn 21 in the transmitting mode, and an equally large portion of the incoming radiation reflected by the main reflector 20 in the receiving mode. Other surfaces of revolution of conic sections that can be employed are ellipsoids and paraboloids, and concave as well as convex subreflectors may be employed. If desired, the subreflector may even include two or more different geometries in concentric regions of the subreflector.

I claim:

1. An omnidirectional microwave antenna comprising a conical reflector having a reflecting surface defined by a cone having an axis and a surface of revolution around said axis, the line of intersection between said surface of revolution and a plane passing through said axis and said surface of revolution being a segment of a parabolic curve, said reflector including a flange extending outward from an outermost circumference of said surface of revolution of said cone, said flange having absorptive material mounted thereto, said flange being generally perpendicular to said axis of said cone, and a conical feed horn located along said axis of said cone and having an aperture therein, the center of said aperture of said feed horn being located approximately at the apex of said cone, said absorptive material absorbing radiation emitted from said feed horn and bypassing said reflector.

2. The antenna of claim 1 wherein the electrical apex of said feed horn is positioned approximately at the focal point of said parabolic curve, and the axis of said feed horn is perpendicular to the axis of said parabolic curve.

3. The antenna of claim 1 wherein said segment of said parabolic curve is the segment between the axis of said feed horn and a point on an outermost edge of said reflecting surface.

4. The antenna of claim 1 wherein said axis of said cone is substantially vertical.

5. The antenna of claim 4 wherein said cone is inverted, and said feed horn is located below said cone along said axis of said cone.

6. The antenna of claim 1 wherein said feed horn is conical in shape and has a surface of revolution defined by a straight segment rotated around the axis of said feed horn.

7. The antenna of claim 6 wherein said straight segment is located along a straight line extending approximately from the focal point of said parabolic curve to an outermost point of said surface of revolution of said cone.

8. The antenna of claim 7 wherein said straight segment extends approximately from the focal point of said parabolic curve to the plane of said aperture of said feed horn, the plane of said aperture of said feed horn passing through the apex of said cone.

9. An omnidirectional microwave antenna comprising a conical reflector having a reflecting surface defined by a cone having an axis and a surface of revolution around said axis, the line of intersection between said surface of revolution and a plane passing through said axis and said surface of revolution being a segment of a parabolic curve, said reflector including a flange extending outward from an outermost circumference of said surface of revolution of said cone, said flange having absorptive material mounted thereto, said flange being generally perpendicular to said axis of said cone, and a feed device for feeding microwave energy to said conical reflector from a location on said axis of said cone, said absorptive material absorbing a portion of said microwave energy which bypasses said reflector.

10. The antenna of claim 9 wherein said feed device is a feed horn having an aperture therein, and the center of said aperture of said feed horn being located substantially at the apex of said cone.

11. The antenna of claim 10 wherein said feed horn is conical in shape and has a surface of revolution defined by a straight segment rotated around the axis of said feed horn.

12. The antenna of claim 11 wherein said straight segment is located along a straight line extending approximately from the focal point of said parabolic curve to an outermost point of said surface of revolution of said cone.

13. The antenna of claim 12 wherein said straight segment extends approximately from the focal point of said parabolic curve to the plane of said aperture of said feed horn, the plane of said aperture of said feed horn passing through the apex of said cone.

14. The antenna of claim 9 wherein said segment of said parabolic curve is the segment between the axis of said feed device and an outermost point at which the radiation pattern from said feed device intesects said parabolic curve.

15. The antenna of claim 9 wherein said axis of said cone is substantially vertical.

16. The antenna of claim 15 wherein said cone is inverted, and said feed device is located below said cone along said axis of said cone.

17. A reflector for use in a microwave antenna, said reflector comprising a reflecting surface defined by a cone having an axis and a surface of revolution around said axis, the line of intersection between said surface of revolution and a plane passing through said axis and said surface of revolution being a segment of a parabolic curve, and a flange extending outward from an outermost circumference of said surface of revolution of said cone, said flange having absorptive material mounted thereto for absorbing microwave energy impinging thereon, said flange being generally perpendicular to said axis of said cone.

* * * * *